US011136638B2

(12) United States Patent
Porret et al.

(10) Patent No.: US 11,136,638 B2
(45) Date of Patent: Oct. 5, 2021

(54) METHOD FOR HEAT TREATMENT OF AUSTENITIC STEELS AND AUSTENITIC STEELS OBTAINED THEREBY

(71) Applicant: The Swatch Group Research and Development Ltd, Marin (CH)

(72) Inventors: Joel Porret, Neuchatel (CH); Christian Charbon, Chezard-St-Martin (CH); Vincent Fays, Peseux (CH)

(73) Assignee: The Swatch Group Research and Development Ltd, Marin (CH)

( * ) Notice: Subject to any disclaimer, the term of this patent is extended or adjusted under 35 U.S.C. 154(b) by 495 days.

(21) Appl. No.: 15/589,067

(22) Filed: May 8, 2017

(65) Prior Publication Data

US 2017/0342520 A1 Nov. 30, 2017

(30) Foreign Application Priority Data

May 27, 2016 (EP) ..... 16171672

(51) Int. Cl.
*C22C 38/22* (2006.01)
*C22C 38/04* (2006.01)
(Continued)

(52) U.S. Cl.
CPC ..... *C21D 9/0068* (2013.01); *C21D 1/18* (2013.01); *C21D 6/002* (2013.01); *C21D 6/02* (2013.01);
(Continued)

(58) Field of Classification Search
CPC ..... C21D 1/18; C21D 2211/001; C21D 2211/004; C21D 2261/00; C21D 6/002;
(Continued)

(56) References Cited

U.S. PATENT DOCUMENTS 4,929,419 A 5/1990 Wegman et al.
5,714,115 A 2/1998 Speidel et al.
(Continued)

FOREIGN PATENT DOCUMENTS

CH 688 862 A5 4/1998
CN 103233174 B 6/2015
(Continued)

OTHER PUBLICATIONS

European Search Report dated Sep. 20, 2016 in European Application 16171672.5 filed on May 27, 2016 (with English Translation of Categories of Cited Documents).
(Continued)

*Primary Examiner* — Anthony M Liang
(74) *Attorney, Agent, or Firm* — Oblon, McClelland, Maier & Neustadt, L.L.P.

(57) ABSTRACT

The invention concerns a method for heat treatment of an austenitic steel of the High Nitrogen Steel or austenitic HNS type, or of an austenitic steel of the High Interstitial Steel or austenitic HIS type, said austenitic HNS or austenitic HIS containing precipitates of nitrides, carbides or carbonitrides of chromium and/or of molybdenum, this method comprising the step which consists, after machining the austenitic HNS or austenitic HIS containing the precipitates, in redissolving the precipitates by bringing the austenitic HNS or austenitic HIS to its austenitizing temperature, then cooling the austenitic HNS or austenitic HIS sufficiently rapidly to avoid the re-formation of precipitates. The invention also concerns different heat treatment methods allowing chromium and/or molybdenum nitride, carbide or carbonitride type precipitates to appear in an austenitic HNS or austenitic HIS. Indeed, the presence of these precipitates in the matrix of the austenitic HNS or austenitic HIS makes machining
(Continued)

operations easier by promoting the formation and removal of chips during machining of the components.

4 Claims, 4 Drawing Sheets

(51) Int. Cl.

| | |
|---|---|
| ***C21D 9/00*** | (2006.01) |
| ***C22C 38/18*** | (2006.01) |
| ***C21D 6/00*** | (2006.01) |
| ***C21D 6/02*** | (2006.01) |
| ***C22C 38/38*** | (2006.01) |
| ***C21D 1/18*** | (2006.01) |
| ***C22C 38/00*** | (2006.01) |

(52) U.S. Cl.
CPC ..... *C22C 38/001* (2013.01); *C22C 38/04* (2013.01); *C22C 38/18* (2013.01); *C22C 38/22* (2013.01); *C22C 38/38* (2013.01); *C21D 2211/001* (2013.01); *C21D 2211/004* (2013.01); *C21D 2261/00* (2013.01)

(58) Field of Classification Search
CPC ..... C21D 6/02; C21D 9/0068; C22C 38/001; C22C 38/04; C22C 38/18; C22C 38/22; C22C 38/38
See application file for complete search history.

(56) References Cited

U.S. PATENT DOCUMENTS

| | | | | |
|---|---|---|---|---|
| 5,841,046 | A * | 11/1998 | Rhodes | B22F 9/082 75/246 |
| 7,255,755 | B2 | 8/2007 | Maziasz et al. | |
| RE41,100 | E | 2/2010 | Maziasz et al. | |
| RE41,504 | E | 8/2010 | Maziasz et al. | |
| 2002/0110476 | A1 | 8/2002 | Maziasz et al. | |
| 2002/0148537 | A1 | 10/2002 | Koga et al. | |
| 2003/0056860 | A1 | 3/2003 | Maziasz et al. | |
| 2003/0084967 | A1 | 5/2003 | Maziasz et al. | |
| 2006/0034724 | A1 | 2/2006 | Hamano et al. | |
| 2006/0193742 | A1* | 8/2006 | Miura | B22F 1/0044 419/52 |
| 2013/0004883 | A1* | 1/2013 | Miura | B21C 37/154 429/515 |

FOREIGN PATENT DOCUMENTS

| | | |
|---|---|---|
| DE | 1 808 256 | 6/1969 |
| EP | 1 229 142 A1 | 8/2002 |
| EP | 1 626 101 A1 | 2/2006 |
| GB | 1 436 655 | 5/1976 |
| JP | 2010-280950 | 12/2010 |
| SU | 722966 | 3/1980 |

OTHER PUBLICATIONS

European Search Report dated Oct. 24, 2016 in European Application 16171672.5 filed on May 27, 2016 (with English Translation of Categories of Cited Documents).
A. Wisniewski, et al., "Influence of heat treatment on creep of a Mn—N stabilized austenitic stainless steel", Journal of Materials Science, vol. 43, (15), 2008, 8 pgs.
Yu N. Goikhenberg, et al., "Stress corrosion cracking, structure, and properties of nitrogen-hardened austenitic chromium-manganese steels", Fizika Metallov | Mettalovedenie, vol. 65, (6), 1988, 7 pgs.
Insu Woo, et al., "Effect of Microstructure on the Heat Affected Zone Toughness of High Nitrogen Containing Ni-Free Austenitic Stainless Steel", Transactions of JWRI, vol. 30, (1), 2001, 8 pgs.
Marcel Sonderegger, et al., "Optimised Sintering and Heat Treatment of the Nickel-free High-Nitrogen MIM-Steel", European Congress and Exhibition on Powder Metallurgy, European PM Conference Proceedings, 2006, 6 pgs.
Tae-Ho Lee, et al., "Time-Temperature-Precipitation Characteristics of High-Nitrogen Austenitic Fe-18Cr-18Mn-2-Mo-0.9N Steel", Metallurgical and Materials Transactions A, vol. 37, (12), 10 pgs.
Daisuke Kuroda, et al., "New Manufacturing Process of Nickel-Free Austenitic Stainless Steel with Nitrogen Absorption Treatment", Material Transactions, vol. 44, (3), 2003, 7 pgs.
Yu-xi Ma, et al., "Study on Precipitation of High Nitrogen Containing Austenitic Stainless Steel During Isothermal Aging at Intermediate Temperature", Proceedings of Sino-Swedish Structural Materials Symposium, Journal of Iron and Steel Research International, vol. 14, (5), 2007, 6 pgs.
J. A. Cotton, et al., "The influence of Niobium and Vanadium on the Microstructure and Mechanical Properties of a High Nitrogen Stainless Steel", Materials Science Forum, vols. 318-320, 1999, 9 pgs.
Hua-bing Li, et al., "Influence of chemical composition and cold deformation on aging precipitation behavior of high nitrogen austenitic stainless steels", Journal of Central South University; Science & Technology of Mining and Metallurgy, vol. 20, (12), 2013, 9 pgs.
Shi Feng, et al., "Effects of Cold Deformation and Aging Process on Precipitation Behavior and Mechanical Properties of Fe-18Cr-18 Mn-0.63N High-Nitrogen Austenitic Stainless Steel", Steel Research International, 2013, 6 pgs.

* cited by examiner

METHOD FOR HEAT TREATMENT OF AUSTENITIC STEELS AND AUSTENITIC STEELS OBTAINED THEREBY

This application claims priority from European Patent Application No. 16171672.5 filed on May 27, 2016, the entire disclosure of which is hereby incorporated herein by reference.

FIELD OF THE INVENTION

The present invention concerns a method for heat treatment of austenitic steels and the austenitic steels obtained by implementing this heat treatment method. More precisely, the present invention concerns austenitic steels alloyed with nitrogen, known as Austenitic High Nitrogen Steels or austenitic HNS. The invention also concerns austenitic steels with a high concentration of interstitial atoms, known as Austenitic High Interstitial Steels or austenitic HIS.

BACKGROUND OF THE INVENTION

Austenitic steels alloyed with nitrogen, which, for convenience, will be referred to hereinafter as "austenitic HNS", and austenitic steels with a high concentration of interstitial atoms, which will be referred to hereinafter as "austenitic HIS", have hardness, corrosion resistance and hypoallergenic properties that make them very attractive, especially for applications in the field of horology and jewellery, both for the fabrication of external elements intended to come into contact with the skin, because of their very low nickel concentration, and for the fabrication of timepiece movement components, since they are very hard, particularly after cold-working.

Austenitic HNS contain nitrogen interstitial atoms in high concentrations which may extend up to 1.5% by weight depending upon the composition and implementation of the alloy. Austenitic HIS, which are directly derived from austenitic HNS, contain large quantities of interstitial atoms of carbon in addition to the interstitial atoms of nitrogen.

As mentioned above, some austenitic HNS and austenitic HIS have attractive hypoallergenic properties due to their very low nickel content and their resistance to corrosion. However, austenitic HNS and austenitic HIS are very difficult to machine, especially as they have a very high elastic limit and cold-working rate and very high ductility. Tests show, for example, that machining operations take 2 to 3 times longer than for 1.4435 steel and there is very heavy wear on the machining tools. The machining of these austenitic HNS and austenitic HIS, which, in many respects, is similar to the machining of titanium, is thus time-consuming, difficult and expensive and is the main obstacle to the use of such steels, particularly in the field of horology and jewellery.

There was, therefore, a need in the state of the art for more easily machinable austenitic steels which maintain their properties of biocompatibility, hardness and corrosion resistance.

SUMMARY OF THE INVENTION

The present invention concerns a method for heat treatment of austenitic steels of the HNS and HIS type, the purpose of which is to make such austenitic steels more easily machinable.

To this end, the present invention concerns a method for heat treatment of austenitic HNS or austenitic HIS containing precipitates of nitrides, carbides or even carbonitrides of chromium and/or of molybdenum, this method comprising the step of, after machining the austenitic HNS or austenitic HIS containing the precipitates, redissolving or putting the precipitates in solution by bringing the austenitic HNS or austenitic HIS to its austenitizing temperature, then cooling the austenitic HNS or austenitic HIS sufficiently rapidly to avoid the re-formation of precipitates.

This feature is very advantageous since, when desired, it makes it possible to eliminate the precipitates once the austenitic HNS or austenitic HIS components have been machined. In the particular case of timepieces, one could make use of this possibility to eliminate the precipitates from the external elements (case middles, watch case backs, bezels, crowns, push pieces, clasps, bracelet links, etcetera), in order to make the material as homogeneous as possible and eliminate residual stresses. The resulting steels will therefore have improved corrosion resistance and higher ductility. The same is true when it is desired to fabricate jewellery.

According to a complementary feature of the invention, to form precipitates in the austenitic HNS or austenitic HIS prior to machining, there is provided an austenitic HNS or austenitic HIS alloy which is brought to its austenitizing temperature or sintered at its austenitizing temperature, then, immediately from the austenitizing temperature, the temperature of the austenitic FINS or austenitic HIS alloy is lowered sufficiently slowly for chromium and/or molybdenum nitride, carbide or carbonitride type precipitates to appear in the resulting austenitic HNS or austenitic HIS structure, and then finally the austenitic HNS or austenitic HIS is returned to ambient temperature.

It will be understood that the step which consists in causing precipitates to form in an austenitic HNS or austenitic HIS precedes the step which, after machining this austenitic HNS or austenitic HIS, consists in putting the precipitates in solution.

It will also be noted that the heat treatment method applies equally well to components obtained by casting and subsequent thermomechanical treatment, as to components obtained by powder metallurgy, such as metal injection moulding or MIM. Indeed, immediately after sintering the alloy at its austenitizing temperature to obtain an austenitic steel of the HNS or HIS type, it is possible to slowly cool the alloy to promote the appearance of precipitates in accordance with the teaching of the present invention.

"Slow cooling" means cooling which, after austenitizing or sintering, promotes the appearance of precipitates in the microstructure of the austenitic HNS and austenitic HIS thus treated, as opposed to the conventional heat and quench treatment which consists in rapid cooling of the HNS and HIS after austenitizing or sintering to prevent the formation of precipitates.

By advocating subjecting the austenitic HNS and austenitic HIS to a slow cooling heat treatment, immediately after austenitizing or sintering at the austenitizing temperature, in order to promote the appearance of precipitates, the invention goes against the usual practice, which consists in cooling the alloys as quickly as possible to prevent as far as possible the formation of precipitates in the resulting austenitic HNS and austenitic HIS.

The Applicant has in fact observed that by subjecting austenitic HNS and austenitic HIS to the aforementioned type of heat treatment, the nitrogen and carbon atoms, for example, tend to migrate to the grain boundaries and combine quite easily with chromium or molybdenum atoms to form precipitates of chromium/molybdenum nitrides, carbides or even carbonitrides. These precipitates have very low adhesion to the matrix, so that they make the chips brittle and facilitate machining operations.

According to another implementation of the method of the invention, in order to make chromium and/or molybdenum nitride, carbide or carbonitride type precipitates appear in the austenitic HNS or austenitic HIS before machining, there is provided an austenitic HNS or austenitic HIS alloy which is brought to its austenitizing temperature or sintered at the austenitizing temperature, then this austenitic HNS or austenitic HIS alloy is subjected to a cooling heat treatment immediately from the austenitizing temperature, and the cooling of the resulting austenitic HNS or austenitic HIS is interrupted when the temperature reaches a value at which precipitates appear, this austenitic HNS or austenitic HIS being maintained at this temperature and for a duration such that precipitates appear, and then finally the austenitic HNS or austenitic HIS is returned to ambient temperature.

According to yet another implementation of the method of the invention, after the austenitic HNS or austenitic HIS has been subjected to an austenitizing or sintering heat treatment at the austenitizing temperature and then to a quenching heat treatment, the austenitic HNS or austenitic HIS is heated again to a temperature and for a duration such that chromium and/or molybdenum nitride, carbide or carbonitride type precipitates appear.

This third variant is the most practical since it makes perfect control of the various heat treatment parameters possible.

The first, second and third implementation variants of the method for heat treatment of an austenitic HNS or austenitic HIS according to the invention are thus more particularly intended for obtaining external elements for timepieces or pieces of jewellery, since they enhance the corrosion resistance of such steels. These first three variants have in common that, after applying an austenitizing heat treatment to an austenitic HNS or austenitic HIS and subsequent machining, the resulting component can in fact be returned to the annealing temperature, and then quenched to put the precipitates in solution.

According to a fourth implementation variant of the method of the invention, an austenitic HNS or austenitic HIS is brought to its annealing temperature, in other words to its austenitizing temperature, and then rapidly cooled (quenched) so that no precipitates are formed, it is cold worked and then this austenitic HNS or austenitic HIS is brought to a temperature and for a duration such that chromium and/or molybdenum nitride, carbide or carbonitride type precipitates appear.

The invention also concerns an element of a timepiece or piece of jewellery obtained from an austenitic HNS or austenitic HIS obtained by implementing the heat treatment method according to the invention.

As a result of these features, the hardness of the austenitic HNS or austenitic HIS obtained after austenitizing and cold working is very little affected by the subsequently performed precipitation treatment according to the invention. However, the machinability of such steels is substantially improved.

BRIEF DESCRIPTION OF THE DRAWINGS

Other features and advantages of the present invention will appear more clearly from the following detailed description of an example of implementation of the method for heat treatment of austenitic HNS and austenitic HIS according to the present invention, this example being given purely by way of non-limiting illustration with reference to the annexed drawing, in which.

DETAILED DESCRIPTION OF ONE EMBODIMENT OF THE INVENTION

The present invention proceeds from the general inventive idea which consists in subjecting austenitic HNS and austenitic HIS to a heat treatment intended to put in solution precipitates made to appear in such austenitic HNS or austenitic HIS, for example during a prior precipitation treatment. "Precipitation heat treatment" means a treatment that intends to place these austenitic HNS and austenitic HIS for a certain duration in temperature conditions that allow precipitates to appear, such as nitrides, carbides or carbonitrides, particularly of molybdenum and/or of chromium. Indeed, it was observed that these precipitates are generally only bound weakly to the matrix of the material, so that they enhance the formation and removal of chips during machining of the components. Thus, according to the invention, after machining components made of an austenitic HNS or austenitic HIS containing precipitates, it is possible to subject these components to a second austenitizing treatment, which consists in returning the components to their annealing temperature and then quenching them to return the precipitates to a solid solution. Since bringing the austenitic HNS and austenitic HIS to their annealing temperature a second time after machining eliminates internal stresses in the material and thus decreases hardness, this annealing treatment will preferably, but in a non-limiting manner, be reserved for external elements for watches or pieces of jewellery for which corrosion resistance and polishability are more important properties than hardness.

Figure 1:
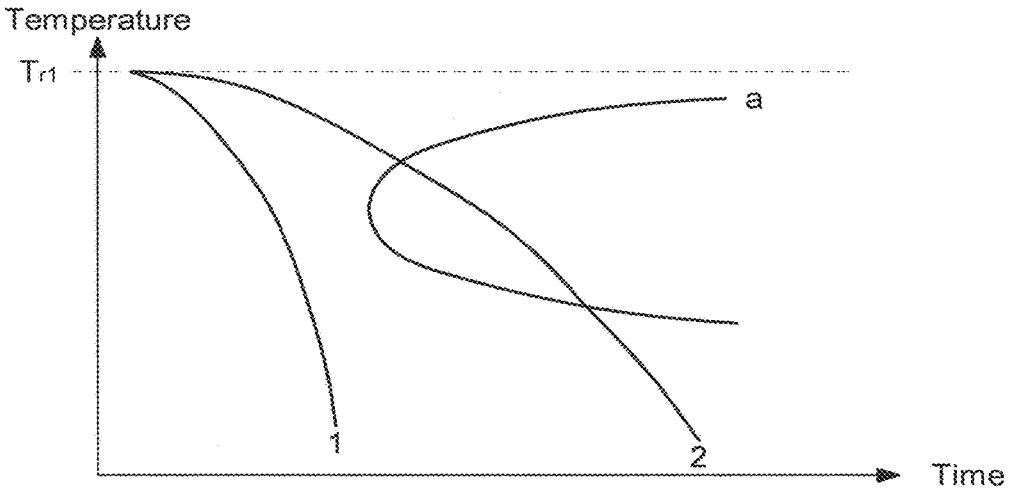
FIG. 1 is a schematic time-temperature-transformation diagram which illustrates the heat treatment of an austenitic HNS or austenitic HIS according to the first implementation variant of the method of the invention.
Figure 2:
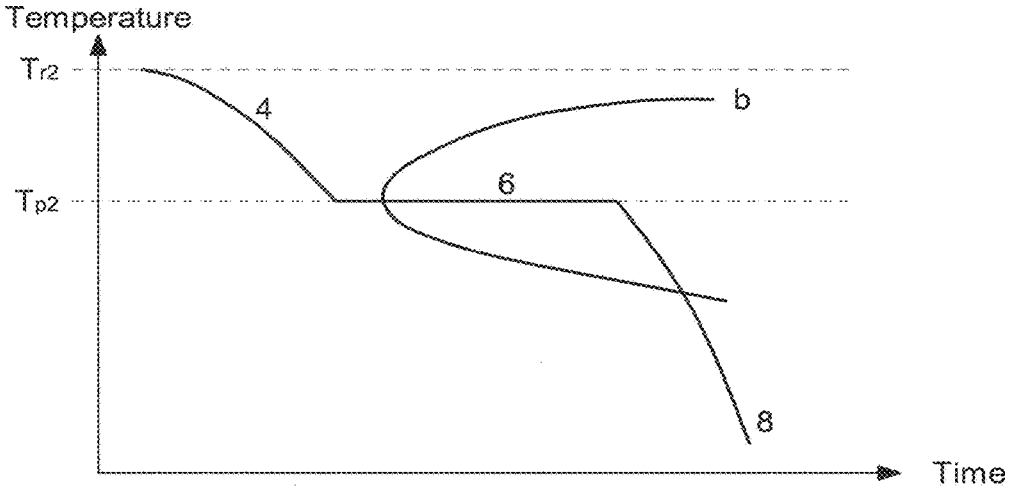
FIG. 2 is a schematic time-temperature-transformation diagram which illustrates the heat treatment of an austenitic HNS or austenitic HIS according to the second implementation variant of the method of the invention.
Figure 3:
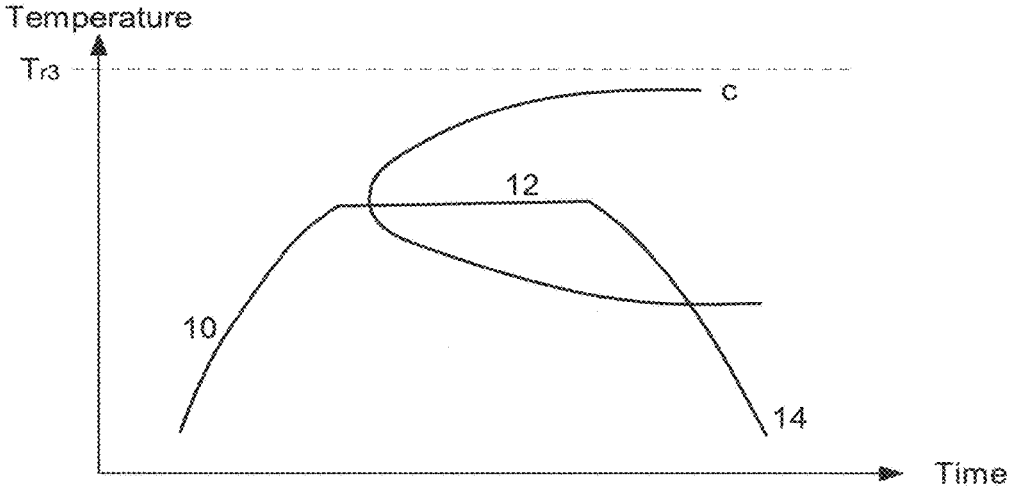
FIG. 3 is a schematic time-temperature-transformation diagram which illustrates the heat treatment of an austenitic HNS or austenitic HIS according to the third implementation variant of the method of the invention.

It will be understood that the diagrams illustrated in FIGS. 1 to 3 are simplified schematic representations. Indeed, each austenitic HNS or austenitic HIS composition has its own time-temperature-transformation diagram which also depends upon the nature of the precipitate concerned.

FIG. 1 is a time (t)-temperature (T)-transformation diagram which illustrates the heat treatment of an austenitic HNS or austenitic HIS according to the first implementation variant of the method of the invention. Tr1 is the austenitizing or annealing temperature of an austenitic steel of the HNS or HIS type and a is the curve which, in the time-temperature-transformation diagram of FIG. 1, delimits an area that corresponds to time and temperature conditions allowing the formation of precipitates. 1 designates the rapid cooling curve which returns the austenitic HNS or austenitic HIS from its annealing temperature to ambient temperature avoiding the formation of precipitates, and 2 the cooling curve according to the invention which combines the time and temperature parameters such that, by lowering the temperature of the austenitic HNS or austenitic HIS following this curve 2, precipitates are allowed to appear in said steel.

FIG. 2 is a time (t)-temperature (T)-transformation diagram which illustrates the heat treatment of an austenitic HNS or austenitic HIS according to the second variant implementation of the method of the invention. Tr2 is the austenitizing or annealing temperature of an austenitic steel of the HNS or HIS type and b is the curve which, in the time-temperature-transformation diagram of FIG. 2, delimits an area that corresponds to time and temperature conditions allowing the formation of precipitates. The treatment starts with rapid cooling of the austenitic HNS or austenitic HIS from its annealing temperature Tr2 according to the curve 4, then the cooling of the austenitic HNS or austenitic HIS is interrupted when the temperature reaches a value Tp2 at which precipitates can appear, and the steel is maintained at temperature Tp2 for a duration such that precipitates appear (curve 6). Finally, the steel is returned to ambient temperature (curve 8).

FIG. 3 is a time (t)-temperature (T)-transformation diagram which illustrates the heat treatment of an austenitic HNS or austenitic HIS according to the third variant implementation of the method of the invention. Tr3 is the austenitizing or annealing temperature of an austenitic steel of the HNS or HIS type and c is the curve which, in the time-temperature-transformation diagram of FIG. 3, delimits an area that corresponds to time and temperature conditions allowing the formation of precipitates. The steel in question here is an austenitic HNS or austenitic HIS that has been cooled sufficiently rapidly from its annealing temperature Tr3 to ambient temperature to avoid the formation of precipitates. According to the third implementation variant of the method of the invention, such an austenitic HNS or austenitic HIS is heated according to curve 10 and maintained at a temperature and for a duration such that precipitates appear (curve 12), and is then cooled (curve 14).

The fourth implementation variant of the invention only differs from the third variant of the same method in that, after the annealing and quenching treatment and before the precipitation treatment, the austenitic HNS or austenitic HIS is cold worked, i.e. cold deformed. The heat treatment according to the invention which consists in bringing an austenitic steel to a temperature and for a duration such that precipitates form is thus applied, in this fourth variant, to a material that is pre-hardened by cold working.

Finally, the fifth and final implementation variant of the method of the invention consists in subjecting the austenitic steel to a cold deformation treatment after heat treatment according to any of the first three implementation variants.

Different tests were conducted on X20CrMnMoN17-11-3 austenitic HIS.

Figure 4:
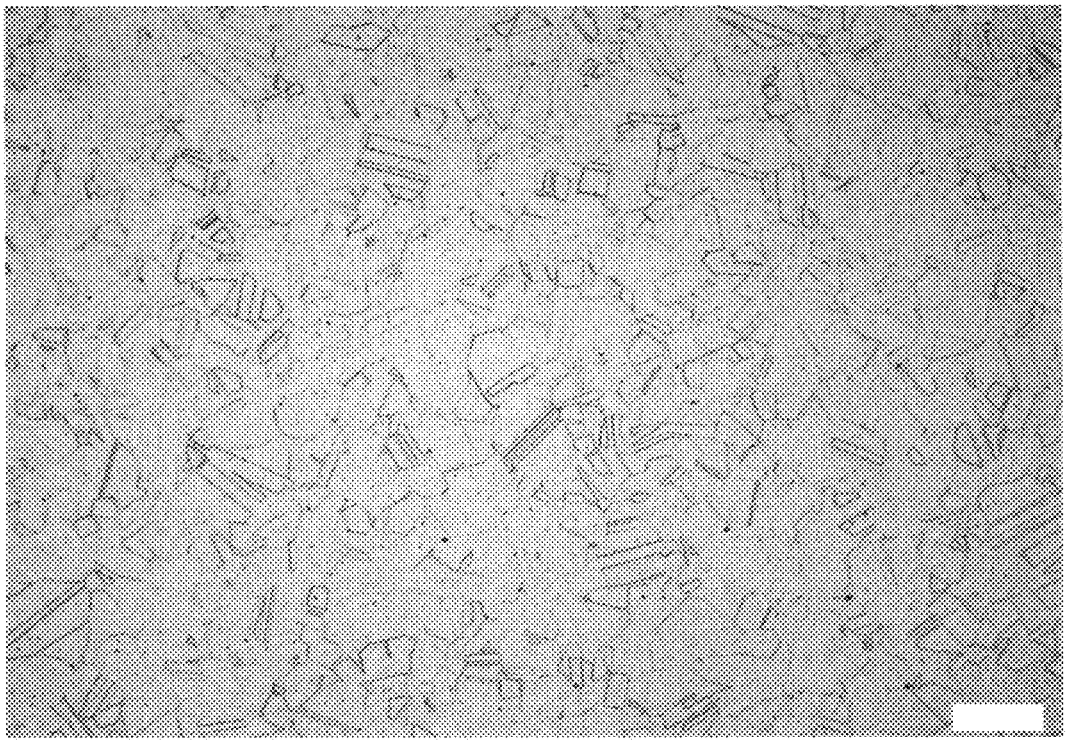
FIG. 4 is a metallographic cross-section of a sample of X20CrMnMoN17-11-3 HIS which was annealed at its austenitizing temperature and then quenched and which has no precipitates.

FIG. 4 is a metallographic cross-section of a sample of HIS X20CrMnMoN17-11-3 steel which was annealed at its austenitizing temperature and then quenched. From an examination of this Figure it is noted that the grain boundaries are barely visible, which indicates a lack of precipitates.

Figure 5:
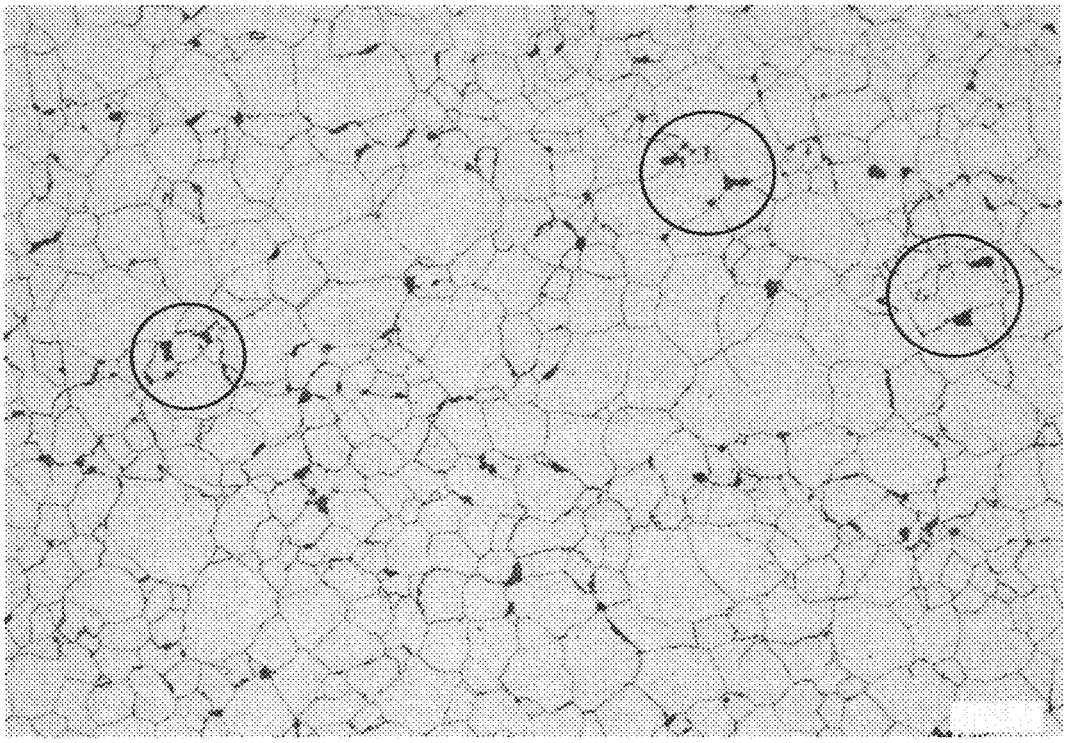
FIG. 5 is a metallographic cross-section of a sample of X20CrMnMoN17-11-3 austenitic HIS that has been subjected to a heat treatment according to the third implementation variant of the method of the invention.

FIG. 5 is a metallographic cross-section of a sample of X20CrMnMoN17-11-3 austenitic HIS that has been subjected to a heat treatment according to the third implementation variant of the method of the invention. From an examination of FIG. 5 it can be seen that the grain boundaries are visible, which indicates the presence of large quantities of precipitates along these grain boundaries. It can even be seen (areas surrounded by a circle in FIG. 5) that some larger precipitates have grown inside the grains from the grain boundaries. It was possible to obtain such a concentration of precipitates by bringing the X20CrMnMoN17-11-3 austenitic HIS to a temperature of 800° C. for two hours, after rapid cooling from the annealing temperature.

For some applications, such as components for a timepiece movement, it is not possible to envisage annealing the components (after precipitation treatment) insofar as one wishes to maintain the hardness obtained after cold working. Samples of X20CrMnMoN17-11-3 austenitic HIS were thus subjected to a heat treatment method according to the fourth variant implementation of the invention, consisting, after an annealing, quenching and cold working treatment, in bringing the X20CrMnMoN17-11-3 austenitic HIS to a temperature and for a duration such that precipitates form. It was observed that the formation of precipitates is much quicker after cold deformation. Indeed, the dislocations and defects caused by cold deformation create diffusion paths promoting germination and the growth of precipitates.

Figure 6:
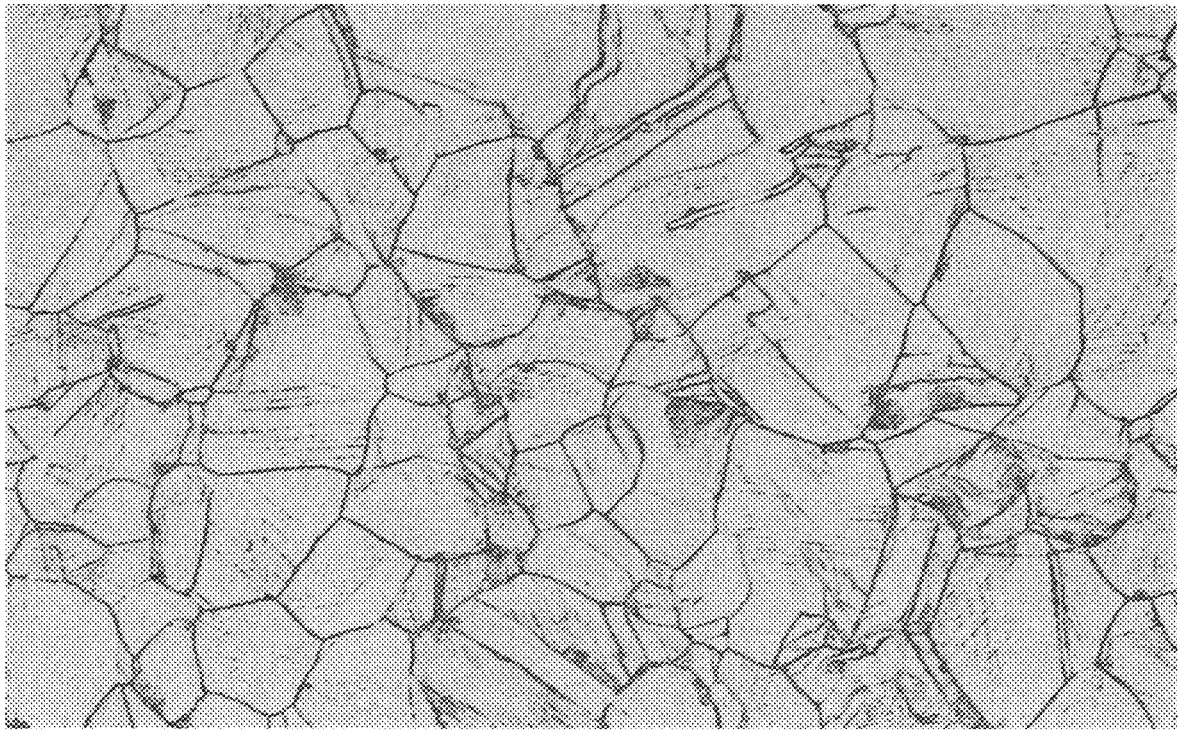
FIG. 6 is a metallographic cross-section of a sample of X20CrMnMoN17-11-3 austenitic HIS that has been subjected to a heat treatment according to the fourth implementation variant of the method of the invention.

FIG. 6 is a metallographic cross-section of a sample of X20CrMnMoN17-11-3 austenitic HIS which takes the form of a bar whose external diameter is reduced from 3 mm to 2.5 mm through cold deformation by drawing, namely a reduction in diameter of 16.6%. According to the fourth implementation variant of the method according to the invention, this sample was then brought to a temperature of 800° C. for two hours according to the temperature curve represented in FIG. 3. It is seen that the steel has numerous precipitates, both at the grain boundaries and inside the grains.

Figure 7:
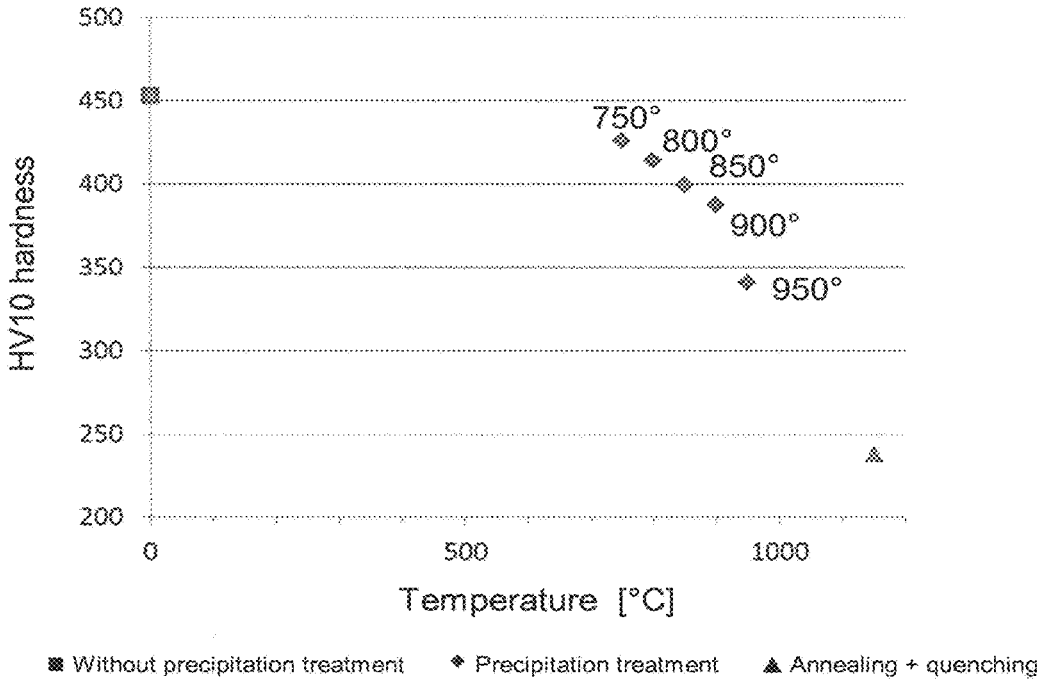
FIG. 7 is a graph that shows the evolution of the hardness of the sample of X20CrMnMoN17-11-3 austenitic HIS of FIG. 6 according to the temperature to which the steel is brought to form the precipitates.

FIG. 7 is a graph that shows the evolution of the hardness of the X20CrMnMoN17-11-3 austenitic HIS of FIG. 6 according to the temperature to which the steel is brought to form the precipitates. It is observed that the hardness of the austenitic steel without the precipitation treatment according to the invention and after cold working is 450 HV10 (square symbol on the graph). The same austenitic steel is subjected, after cold working, to the heat treatment according to the fourth implementation variant of the method of the invention. Samples of this steel are respectively brought to temperatures of 750° C., 800° C., 850° C., 900° C. and 950° C. for a duration of two hours, then cooled (diamond-shaped symbol on the graph). It is observed that, for the samples heated between 700° C. and 900° C., the hardness is comprised between around 425 HV10 and 375 HV10. In other words, the hardness of these austenitic steel samples, which are heat treated according to the fourth variant of the invention, varies little with respect to the hardness of the cold worked austenitic steel that has not been subjected to a precipitation treatment. However, the machinability of the austenitic steel samples subjected to a precipitation heat treatment according to this fourth variant of the invention is markedly improved. Only the austenitic steel sample heated to 950° C. for two hours has a substantially lower hardness than that of the austenitic steel without precipitation treatment (less than 350 HV10). Finally, a sample of X20CrMnMoN17-11-3 austenitic HIS subjected only to an annealing treatment followed by quenching (triangular symbol on the graph) has a hardness of less than 250 HV10.

Figure 8:
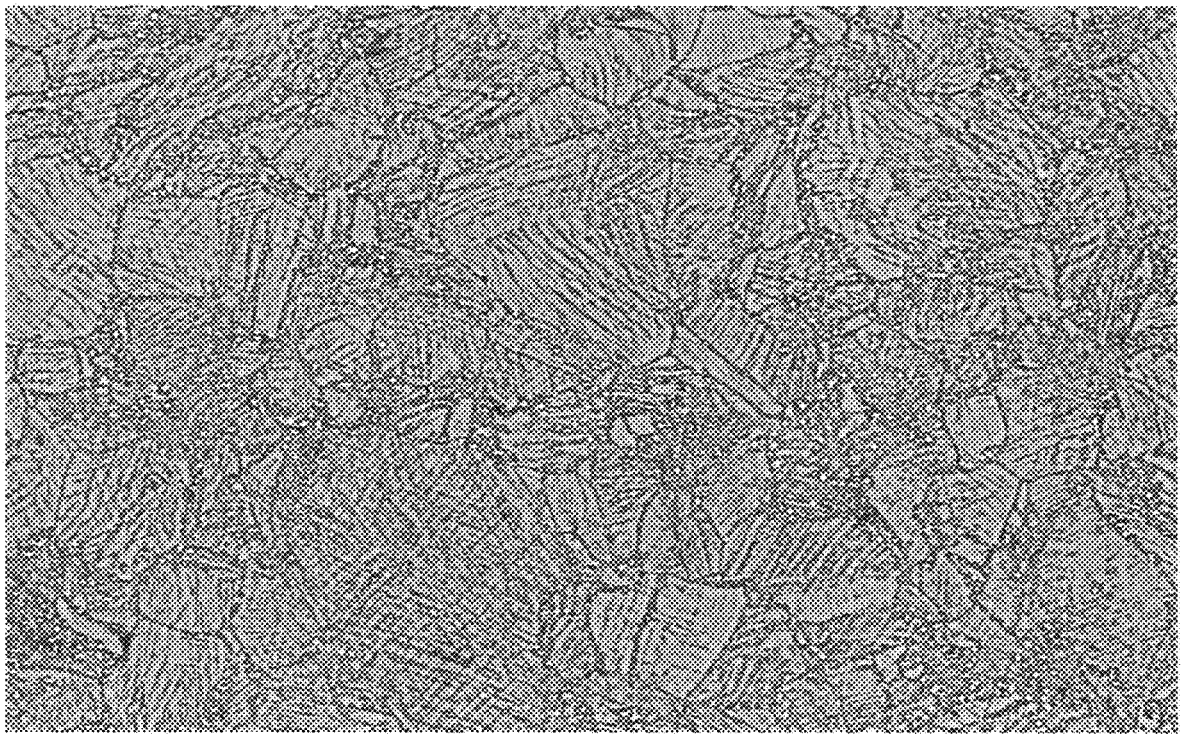
FIG. 8 is a metallographic cross-section of a sample of X20CrMnMoN17-11-3 austenitic HIS that has been subjected to higher cold working than the austenitic steel sample of FIG. 6 before a heat treatment according to the fourth implementation variant of the method of the invention.

FIG. 8 is a metallographic cross-section of a sample of X20CrMnMoN17-11-3 austenitic HIS, which takes the form of a bar, whose external diameter is reduced from 3 mm to 2 mm through cold deformation by drawing, namely an even greater reduction in diameter of 33.3%. This steel sample is subjected to the same heat treatment as in FIG. 6, by being brought to a temperature of 800° C. for two hours according to the fourth implementation variant of the invention. It is seen that, compared to FIG. 6, the precipitation phenomenon is even more marked, since, in addition to the precipitates that form along the grain boundaries and from the grain boundaries towards the interior of the grains, there is a high concentration of precipitates actually inside the grains.

Figure 9:
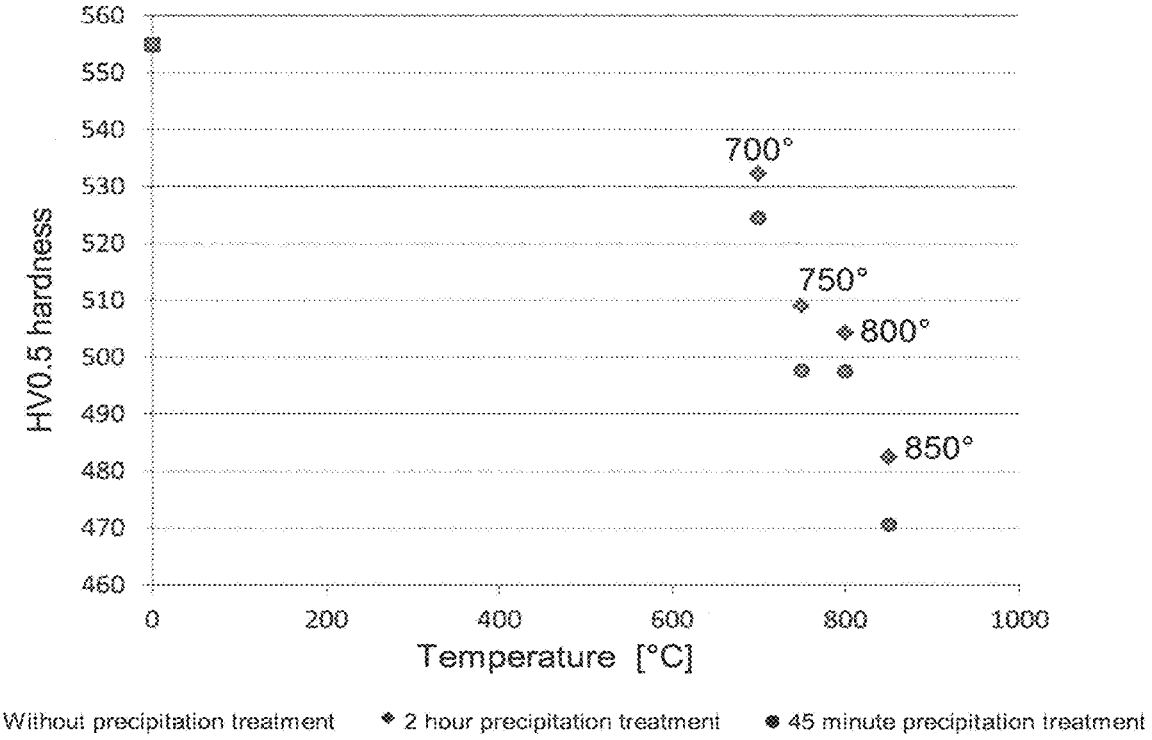
FIG. 9 is a graph that shows the evolution of the hardness of the sample of X20CrMnMoN17-11-3 austenitic HIS of FIG. 8 according to the temperature to which the steel is brought to form the precipitates.

FIG. 9 is a graph that shows the evolution of the hardness of the steel of FIG. 8 according to the hardness and to the temperature to which the steel is brought, after cold working, to form the precipitates. It is observed that the hardness of the austenitic steel without the precipitation treatment according to the invention and after cold working is comprised between 550 HV10 and 560 HV10 (square-shaped symbol on the graph). This hardness is greater than that of FIG. 7, since the cold working rate is higher. The diamond-shaped symbols in FIG. 9 correspond to austenitic steel samples brought to respective temperatures of 700° C., 750° C., 800° C. and 850° C. for 45 minutes. The round-shaped symbols correspond to austenitic steel samples brought to respective temperatures of 700° C., 750° C., 800° C. and 850° C. for two hours. A comparison of the graphs of FIGS. 7 and 9 reveals that the higher the cold working rate, the easier it is for precipitates to form. Indeed, mechanical tensions within the steel make it possible for precipitates to nucleate and grow.

It is observed that, for the same precipitation treatment temperature, the hardness of the austenitic steel samples is lower when the duration of the precipitation treatment is longer. It is also observed that, for the same two-hour treatment duration, the higher the precipitation temperature, the lower the steel hardness. However, these graphs show that it is possible to obtain steels with many precipitates and with a hardness that is nonetheless close to the initial hardness.

It goes without saying that this invention is not limited to the embodiment that has just been described and that various simple modifications and variants can be envisaged by those skilled in the art without departing from the scope of the invention as defined by the annexed claims. A few non-limiting examples of HNS and HIS to which the precipitation method according to the invention can be applied are: X5CrMnN18-18, X8CrMnN19-19, X8CrMnMoN18-18-2, X13CrMnMoN18-14-3, X20CrMnMoN17-11-3 or even X5MnCrMoN23-21. Finally, a few examples of precipitates that may form during the precipitation method are: M23C, MC, M6C or even M2N, where M designates one or more of the metallic elements of the alloy able to combine with the carbon or with the nitrogen to form carbides or nitrides or carbonitrides. The invention applies especially to pieces of jewellery and to the external elements of timepieces.

It is understood from the foregoing that it is advantageous to machine an element, for example for a piece of jewellery or a wristwatch, using an austenitic steel of the HNS or HIS type containing precipitates. It may, however, also be advantageous, after machining, to make these precipitates disappear. Indeed, although the precipitates make machining operations easier by promoting the formation and removal of chips during machining of the components, it may be advantageous to eliminate these chips after machining to improve the ductility and corrosion resistance of these components. This is why the present invention teaches a method for heat treatment of an austenitic HNS or HIS containing precipitates, this method including the step that consists, after machining components, particularly for jewellery or horology, made using an austenitic HNS or austenitic HIS containing precipitates, in redissolving or putting the precipitates again in solution by bringing the austenitic HNS or austenitic HIS components to their austenitizing temperature, and then cooling the components sufficiently rapidly, typically by quenching, to prevent precipitates forming again. "Machining operations" mean in particular but not in a limiting manner, the operations of boring, milling, drilling, threading, tapping and cutting.

What is claimed is:

1. A method for heat treatment of an austenitic High Nitrogen Steel (HNS), or of an austenitic High Interstitial Steel (HIS), said austenitic HNS or austenitic HIS comprising precipitates of nitrides, carbides or carbonitrides of chromium and/or of molybdenum, the method consisting of:

machining the austenitic HNS or austenitic HIS containing the precipitates, after the machining, redissolving the precipitates in solution by bringing the austenitic HNS or austenitic HIS to its austenitizing temperature, then cooling the austenitic HNS or austenitic HIS sufficiently rapidly to avoid re-formation of precipitates, wherein, in order to make chromium and/or molybdenum nitride, carbide or carbonitride precipitates appear in the austenitic HNS or austenitic HIS before machining:

providing an austenitic HNS or austenitic HIS alloy which is brought to its austenitizing temperature or sintered at the austenitizing temperature, then, immediately from the austenitizing temperature, lowering a temperature of the austenitic HNS or austenitic HIS alloy sufficiently slowly for the precipitates to appear in a resulting austenitic HNS or HIS structure, then finally returning the austenitic HNS or austenitic HIS to ambient temperature.

2. A method for heat treatment of an austenitic High Nitrogen Steel (HNS), or of an austenitic High Interstitial Steel (HIS), said austenitic HNS or austenitic HIS comprising precipitates of nitrides, carbides or carbonitrides of chromium and/or of molybdenum, the method consisting of:

machining the austenitic HNS or austenitic HIS containing the precipitates, after the machining, redissolving the precipitates in solution by bringing the austenitic HNS or austenitic HIS to its austenitizing temperature, then cooling the austenitic HNS or austenitic HIS sufficiently rapidly to avoid re-formation of precipitates, wherein, in order to make chromium and/or molybdenum nitride, carbide or carbonitride precipitates appear in the austenitic HNS or austenitic HIS before machining:

providing an austenitic HNS or austenitic HIS alloy which is brought to its austenitizing temperature or sintered at the austenitizing temperature, then subjecting the austenitic HNS or austenitic HIS alloy to cooling immediately from the austenitizing temperature, interrupting the cooling of a resulting austenitic HNS or austenitic HIS when a temperature reaches a value at which the precipitates appear, maintaining the austenitic HNS or austenitic HIS at this temperature for a duration such that the precipitates appear, and then finally returning the austenitic HNS or austenitic HIS to ambient temperature.

3. A method for heat treatment of an austenitic High Nitrogen Steel (HNS), or of an austenitic High Interstitial Steel (HIS), said austenitic HNS or austenitic HIS comprising precipitates of nitrides, carbides or carbonitrides of chromium and/or of molybdenum, the method consisting of:

machining the austenitic HNS or austenitic HIS containing the precipitates, after the machining, redissolving the precipitates in solution by bringing the austenitic HNS or austenitic HIS to its austenitizing temperature, then cooling the austenitic HNS or austenitic HIS sufficiently rapidly to avoid re-formation of precipitates, wherein, in order to make chromium and/or molybdenum nitride, carbide or carbonitride precipitates appear in the austenitic HNS or austenitic HIS before machining:

subjecting an austenitic HNS or austenitic HIS alloy to an austenitizing heat treatment or to a sintering heat treatment at the austenitizing temperature, then quenching the austenitic HNS or austenitic HIS alloy and reheating to a temperature and maintaining at this temperature for a duration such that chromium and/or molybdenum nitride, carbide or carbonitride precipitates appear, wherein, after quenching and before bringing the austenitic HNS or austenitic HIS to a temperature and maintaining at this temperature for a duration such that chromium and/or molybdenum nitride, carbide or carbonitride precipitates appear, optionally cold deforming the austenitic HNS or austenitic HIS.

4. The method according to claim 3, consisting of:

machining the austenitic HNS or austenitic HIS containing the precipitates, after the machining, redissolving the precipitates in solution by bringing the austenitic HNS or austenitic HIS to its austenitizing temperature, then cooling the austenitic HNS or austenitic HIS sufficiently rapidly to avoid re-formation of precipitates, wherein, in order to make chromium and/or molybdenum nitride, carbide or carbonitride precipitates appear in the austenitic HNS or austenitic HIS before machining:

subjecting an austenitic HNS or austenitic HIS alloy to an austenitizing heat treatment or to a sintering heat treatment at the austenitizing temperature, then quenching the austenitic HNS or austenitic HIS alloy and reheating to a temperature and maintaining at this temperature for a duration such that chromium and/or molybdenum nitride, carbide or carbonitride precipitates appear, wherein, after quenching and before bringing the austenitic HNS or austenitic HIS to a temperature and maintaining at this temperature for a duration such that chromium and/or molybdenum nitride, carbide or carbonitride precipitates appear, cold deforming the austenitic HNS or austenitic HIS.

* * * * *